US009039844B2

(12) United States Patent
Pears et al.

(10) Patent No.: US 9,039,844 B2
(45) Date of Patent: May 26, 2015

(54) STEAM CLEANING APPARATUS

(75) Inventors: Barry Pears, Durham (GB); David Rowntree, Durham (GB); Martyn Riley, Newcastle Upon Tyne (GB); Stephen Houghton, Newcastle Upon Tyne (GB); Andrew Walker, Durham (GB)

(73) Assignee: BLACK & DECKER INC., Newark, DE (US)

( * ) Notice: Subject to any disclaimer, the term of this patent is extended or adjusted under 35 U.S.C. 154(b) by 646 days.

(21) Appl. No.: 13/405,593

(22) Filed: Feb. 27, 2012

(65) Prior Publication Data

US 2012/0222706 A1 Sep. 6, 2012

(30) Foreign Application Priority Data

Mar. 1, 2011 (GB) ..... 1103604.3

(51) Int. Cl.

| | |
|---|---|
| ***B08B 3/00*** | (2006.01) |
| ***A47L 13/22*** | (2006.01) |
| ***A47L 11/40*** | (2006.01) |

(52) U.S. Cl.

CPC ..... *A47L 13/225* (2013.01); *A47L 11/4008* (2013.01)

(58) Field of Classification Search

None

See application file for complete search history.

(56) References Cited

U.S. PATENT DOCUMENTS

| | | | |
|---|---|---|---|
| 2010/0116298 | A1 | 5/2010 | Rosenzweig et al. |
| 2010/0236018 | A1 | 9/2010 | Vrdoljak et al. |

FOREIGN PATENT DOCUMENTS

| | | | |
|---|---|---|---|
| DE | 20302630 | | 4/2003 |
| WO | 2009137792 | A2 | 11/2009 |

OTHER PUBLICATIONS

European Search Report dated May 12, 2014 for EP Application No. 12156197.1.

*Primary Examiner* — Eric Golightly

(74) *Attorney, Agent, or Firm* — John Yun

(57) ABSTRACT

A steam cleaning apparatus including a main body having a main switch, a steam cleaning head coupled to the main body, and a position sensitive switch having a first state when the steam apparatus is in a substantially vertical storage position and a second state when the steam cleaning apparatus is in a tilted, cleaning position, the position sensitive switch being connected in electrical series with the main switch such that when the position-sensitive switch is in the first state the position-sensitive switch interrupts the flow of electrical current from the main switch and when the position-sensitive switch is in the second state, electrical power is supplied by the main switch.

5 Claims, 5 Drawing Sheets

STEAM CLEANING APPARATUS

BACKGROUND OF THE INVENTION

The present invention concerns a steam cleaning apparatus, and more particularly, a steam cleaning apparatus of the type suitable for cleaning floors in a domestic environment. The present invention does not concern vacuum cleaners having a steam-generating function, which are a different type of floor cleaning apparatus from those envisaged herein.

Steam cleaning apparatuses which do not incorporate a vacuuming function, are known and examples of them are described in US-A-2010/0126533, WO-A-10/0017657 and US-A-2007/0130719. Other examples can be found on the market under brands such as Euro-Pro™ and Simac-Vetrella™. However, these steam cleaning apparatuses have only become popular in the last few years, and are still undergoing rapid development. It is therefore an object of the present invention to provide a steam cleaning apparatus with improved convenience for users and enhanced functions.

SUMMARY OF THE INVENTION

Accordingly, the present invention provides a steam cleaning apparatus comprising: a water tank having a first inlet for water, a second inlet for air, and an outlet, the first inlet being sealable in an airtight manner; a first valve having an inlet and an outlet, the outlet being in fluid communication with the second inlet of the water tank, the first valve being arranged to allow air to flow into the second inlet of the water tank and to prevent air and/or water from flowing out therefrom; an electrically powered air pump having an inlet in fluid communication with atmospheric air and an outlet in fluid communication with the inlet of the first valve; an electrically powered boiler having an inlet for water in fluid communication with the outlet of the water tank, the boiler heating water to generate steam and having an outlet for such steam; a second valve having an inlet and an outlet, the inlet being in fluid communication with the outlet of the water tank, and the outlet being in fluid communication with the inlet of the boiler, the second valve being arranged to allow water above a first predetermined pressure to flow into the inlet of the boiler and to prevent steam from flowing out therefrom; a steam cleaning head in fluid communication with the outlet of the boiler; and an on-off switch having an "on" state for supplying electrical power to the air pump and to the boiler and an "off" state for preventing supply of electrical power to the air pump and to the boiler, whereby if water is introduced into the water tank and the first inlet thereof is sealed in an airtight manner, when the on-off switch is placed in the "on" state, the air pump pumps air through the first valve into the water tank, pressurising the water therein until the water reaches said first predetermined pressure, whereupon the water flows from the water tank through the second valve into the boiler, where the water is heated to generate steam which emerges from the steam cleaning head.

Such a steam cleaning apparatus has the advantage that it is electrically pumped, in comparison to known examples, which must be manually pumped by a user. This makes it more convenient for the user, who does not have to keep pumping water from the water tank into the boiler in order to ensure that steam is generated by the apparatus. It also helps to maintain a steady and consistent flow of steam, whilst preventing the boiler from overheating, in case the user accidentally stops pumping water from the water tank. The electrical power for the air pump may be supplied from a source of mains electricity. Alternatively or additionally, it may be supplied from an electrical battery mounted on the steam cleaning apparatus.

Preferably, the water tank further comprises a second outlet, and the steam cleaning apparatus further comprises a pressure release valve having an inlet in fluid communication with the second outlet of the water tank, and an outlet in fluid communication with atmospheric air, the pressure release valve being arranged to allow water and/or air above a second predetermined pressure greater than said first predetermined pressure to flow from the water tank to atmospheric air. This arrangement provides the steam cleaning apparatus with a safety mechanism to ensure that pressure is released to atmospheric air without being able to reach dangerous levels if steam is prevented from emerging from the steam cleaning head by a blockage or obstruction.

In a preferred embodiment, the steam cleaning apparatus further comprises a position-sensitive switch having a first state when the steam cleaning apparatus is in a substantially vertical, storage position and a second state when the steam cleaning apparatus is in a tilted, cleaning position, the position-sensitive switch being operatively connected to the on-off switch such that when the position-sensitive switch is in the first state, the on-off switch is put in the "off" state, and when the position-sensitive switch is in the second state, the on-off switch is put in the "on" state. The provision of such a position-sensitive switch allows the steam cleaning apparatus to be switched from a disabled condition into a usable condition and back again merely by a user moving the apparatus from the substantially vertical, storage position into the tilted, cleaning position, which is very convenient for the user, and also acts as a safety feature by preventing the apparatus from being left on when stored. Alternatively or additionally, the pressure release valve may preferably be arranged such that it is opened when the steam cleaning apparatus is in a substantially vertical, storage position, whereas when the steam cleaning apparatus is in a tilted, cleaning position, the pressure release valve only allows water and/or air above said second predetermined pressure to flow from the water tank to atmospheric air. This also has the beneficial effect of ensuring that the apparatus cannot be left in a pressurised state when stored.

Preferably, the first valve is a regulator valve further comprising a vent and a pressure adjustor, the pressure adjustor being arranged to divert air from the inlet of the first valve to the vent thereof in preference to the outlet thereof in a ratio dependent upon the condition of the pressure adjustor, whereby adjusting the condition of the pressure adjustor can be used to vary the amount of air supplied by the air pump to the water tank. This has the effect of adjusting the amount of steam which emerges from the steam cleaning head, which in turn allows the steam cleaning apparatus to be used on different types of floor surfaces for which different amounts of steam are respectively appropriate (such as carpets, wood laminate floorings and tiles), by the user adjusting the condition of the pressure adjustor.

Preferably, the steam cleaning apparatus also comprises a water filter having an inlet in fluid communication with the outlet of the water tank, and an outlet in fluid communication with the inlet of the second valve, the water filter comprising an ion-exchange resin. Such a water filter has the advantage of ensuring that if the water tank of the steam cleaning apparatus is filled with hard water, the apparatus does not become blocked with residue from low solubility salts like calcium carbonate contained in the water, which are instead removed by the ion exchange resin before the water is heated to generate steam.

Preferably, the steam cleaning apparatus further comprises a time-delay circuit operatively connected between the on-off switch and the air pump for introducing a time delay into a supply of electrical power to the air pump, whereby the boiler is able to reach operating temperature during said time delay before the boiler receives water from the water tank as a result of the air pump starting to pump air into said tank. This has the advantage of ensuring that the boiler does not undesirably generate hot water instead of steam during the period in which the boiler has not yet reached operating temperature.

In a preferred embodiment, the steam cleaning apparatus also comprises an indicator light having a first colour for indicating when the steam cleaning apparatus is powered on but is not ready to use and a second colour for indicating when the steam cleaning apparatus is powered on and is ready to use, the indicator light having a first condition associated with the first colour, a second condition associated with the second colour and a third condition not associated with either the first or the second colour, wherein the first condition of the indicator light is induced by the on-off switch being in the "on" state and the air pump being prevented from receiving a supply of electrical power by the time delay circuit, the second condition is induced by the on-off switch being in the "on" state and the air pump receiving a supply of electrical power unhindered by the time delay circuit, and the third condition is induced by the on-off switch being in the "off" state thereof. The provision of such an indicator light has the advantage of informing the user not only of whether the steam cleaning apparatus is switched on or off, but also whether the steam cleaning apparatus is ready to be used for cleaning.

Preferably, the steam cleaning apparatus further comprises a thermostat for detecting the temperature of steam generated by the boiler and for controlling the temperature of the boiler to remain within a range of temperatures of between 100 and 155 degrees Celsius. This ensures that the temperature of the steam emerging from the steam cleaning head is within the optimum range for cleaning and sterilizing surfaces, without being so hot as to risk damaging them. More prefer still, the thermostat controls the temperature of the boiler to remain within a range of temperatures of between 110 and 145 degrees Celsius, which is the ideal range for the steam emerging from the steam cleaning head to have these effects.

Preferably, if the steam cleaning apparatus does comprise such a thermostat as well as an indicator light as just described, the indicator light is arranged to operate such that the first condition of the indicator light is induced by the on-off switch being in the "on" state and either the air pump being prevented from receiving a supply of electrical power by the time delay circuit or the thermostat detecting that the temperature of steam generated by the boiler is outside said temperature range, and the second condition of the indicator light is induced by the on-off switch being in the "on" state, the air pump receiving a supply of electrical power unhindered by the time delay circuit and the thermostat detecting that the temperature of steam generated by the boiler is within said temperature range. Thus, the indicator light will not show to a user that the steam cleaning apparatus is ready to be used if there is not steam emerging from the steam cleaning head within the optimum range for cleaning and sterilizing surfaces, without being so hot as to risk damaging them.

Further features and advantages of the present invention will become apparent from the following detailed description, which is given by way of example and in association with the accompanying drawings, in which:

DETAILED DESCRIPTION OF THE DRAWINGS

Figure 1:
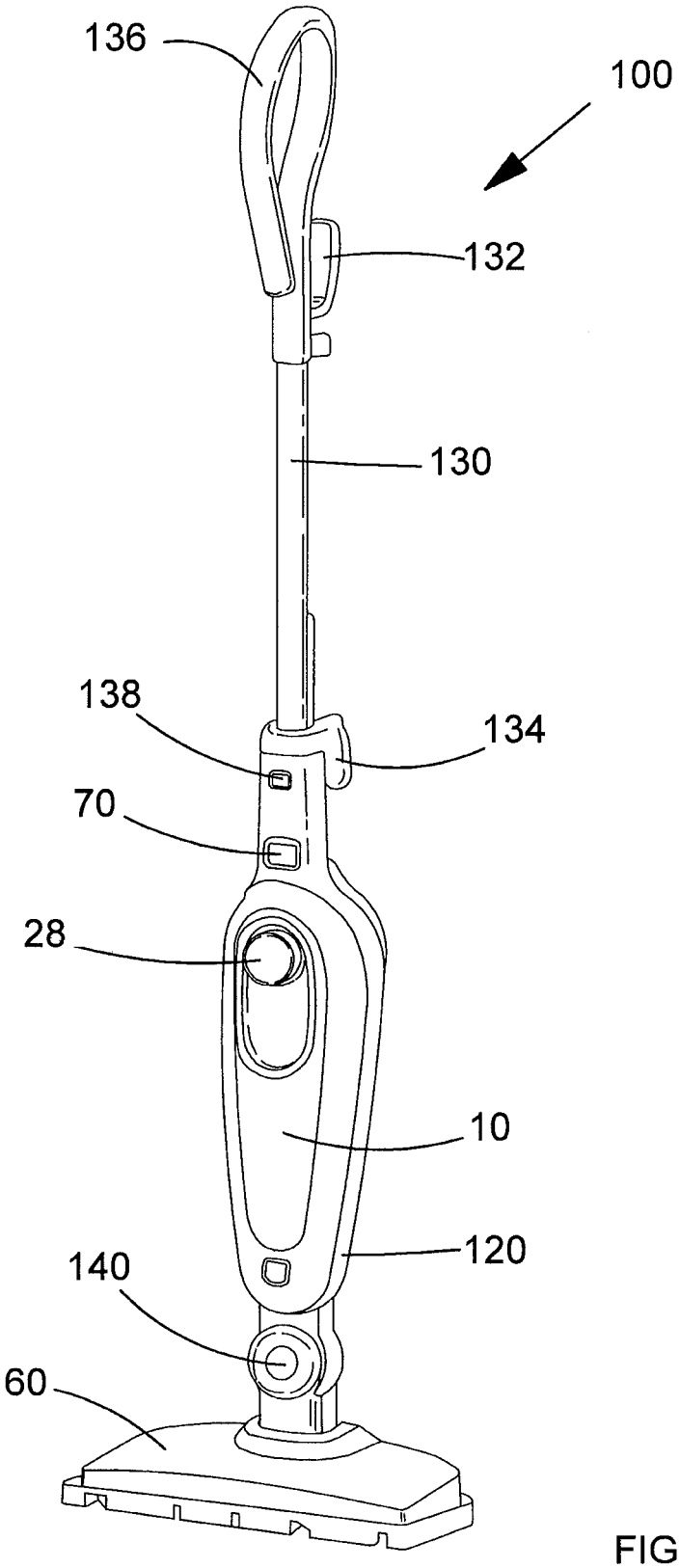
FIG. 1 is a general view of a steam cleaning apparatus according to an embodiment of the invention.

Referring firstly to FIG. 1, there is shown a general view of a steam cleaning apparatus 100 having a main body portion 120, the lower end of which is mounted to a floor cleaning head 60. On the front of the main body portion 120, there can be seen an electrical power on-off switch 70, an adjustor dial 28, whereby a user can adjust the pressure and amount of steam emerging from steam cleaning head 60, and a water tank 10. The water tank can be filled through a water inlet 12 (shown in FIGS. 3 and 5) mounted on the back of main body portion 120. An upper end of main body portion 120 is connected to a handle portion 130, which includes upper 132 and lower 134 hooks for a user to be able to coil an electrical cable around. At the top end of handle portion 130 is a loop handle 136 for a user to be able to pick up the steam cleaning apparatus 100.

The height of handle portion 130 may be adjusted by a user by depressing a resilient height adjustment button 138 and by sliding handle portion 130 into and out of main body portion 120 as desired until a catch on the interior of height adjustment button 138 engages with a corresponding detent in handle portion 130. A universal joint 140 joins the lower end of main body portion 120 to the steam cleaning head 60 and allows the steam cleaning apparatus to be pivoted by the user as desired.

Figure 2:
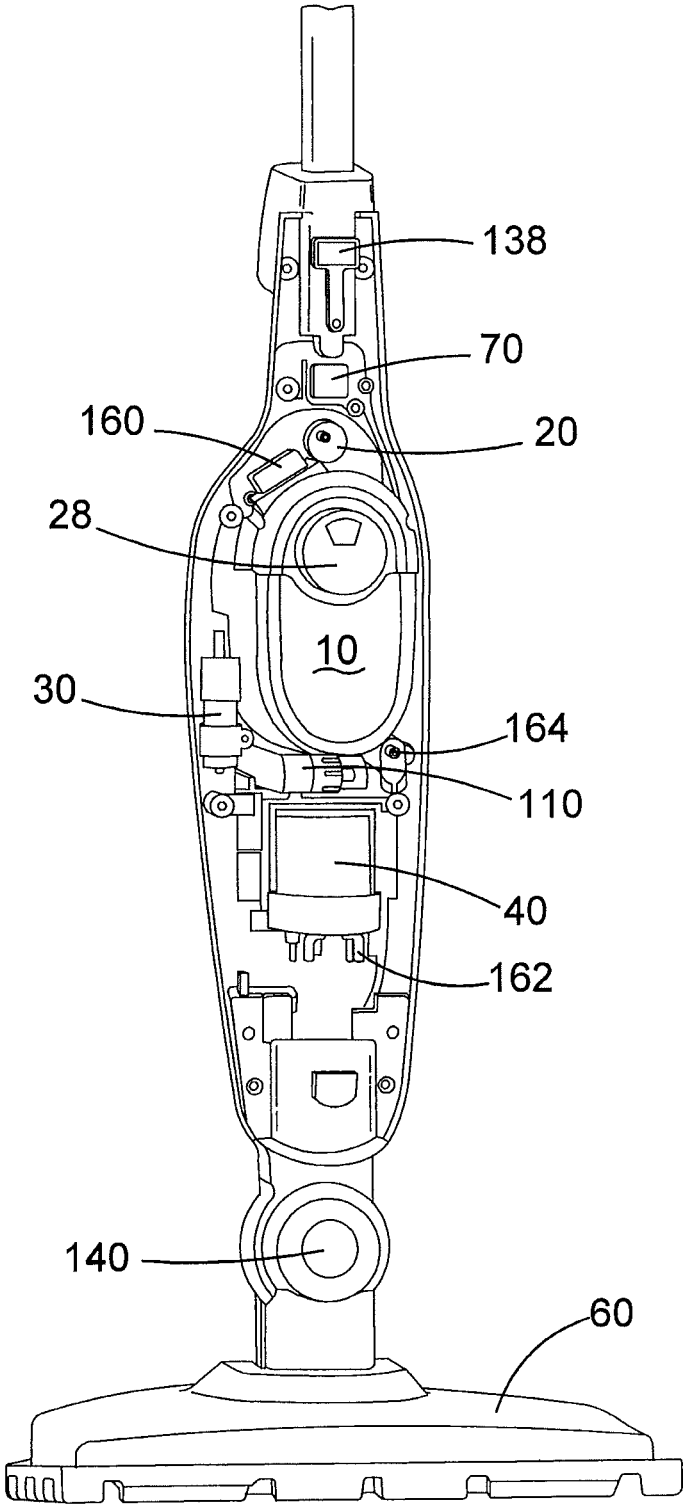
FIG. 2 is an exposed view of a main body portion of the steam cleaning apparatus shown in FIG. 1.

FIG. 2 shows main body portion 120 of the steam cleaning apparatus 100 with a front cover removed in order to expose its interior. As can be seen in FIG. 2, main body portion 120 houses water tank 10, an air pump 30, a valve 20 in fluid communication between the water tank 10 and the air pump 30, and a boiler 40, as the main components thereof, as well as a water filter 110 located in fluid communication between the water tank 10 and the boiler 40.

Figure 3:
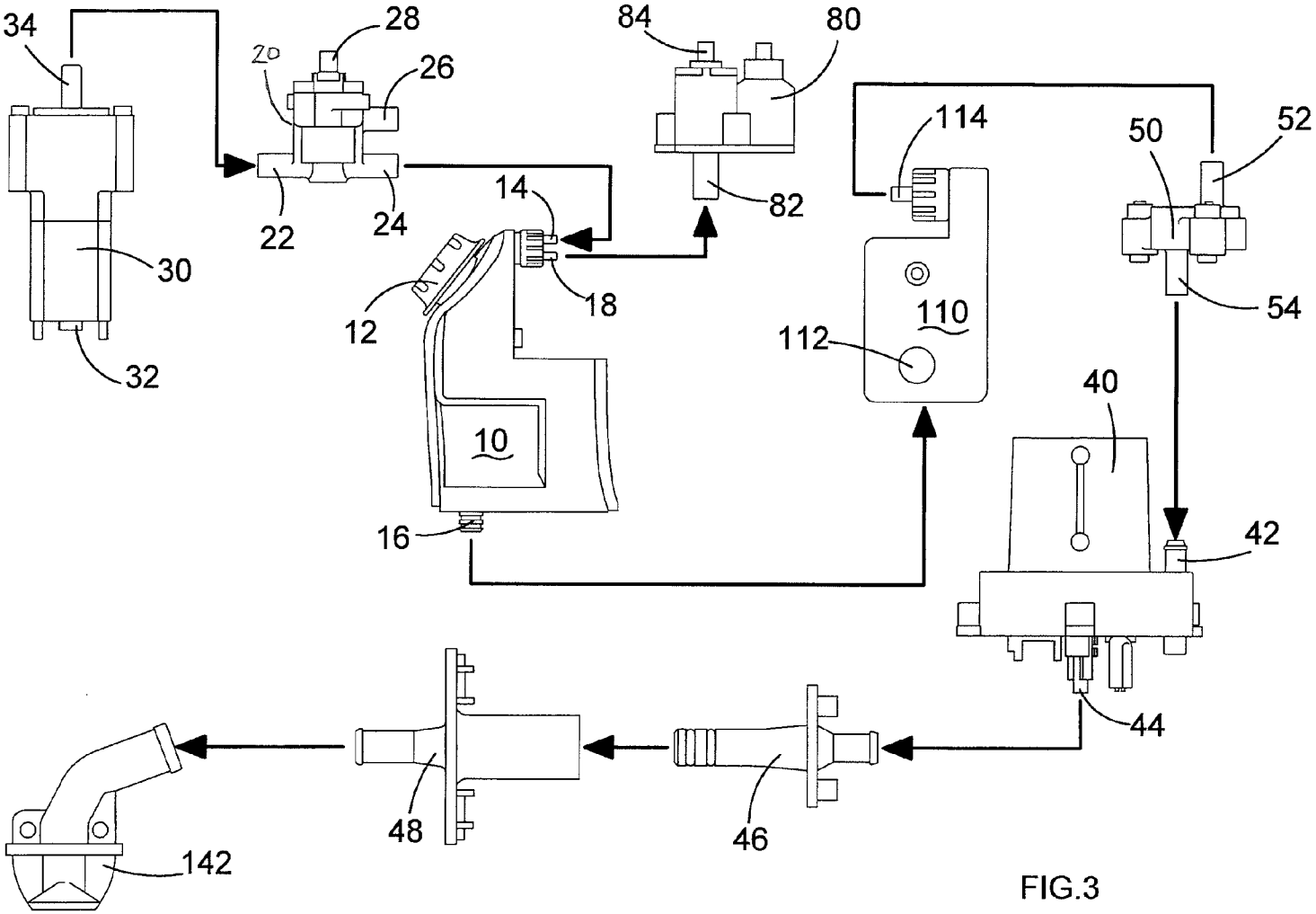
FIG. 3 is a schematic diagram of the functional components of the steam cleaning apparatus shown in FIGS. 1 and 2.

FIG. 3 schematically shows the layout of the functional components of the steam cleaning apparatus shown in FIGS. 1 and 2, the operation of which will now be described.

Electrically powered air pump 30 receives atmospheric air via inlet 32 thereof, compresses it, and expels the compressed air via outlet 34. Air pump 30 is of a conventional type which compresses the incoming atmospheric air via the action of alternating pistons.

The compressed air is then passed to inlet 22 of first valve 20. First valve 20 has two outlets 24 and 26. The first outlet 24 is connected to an inlet 14 of water tank 10. The second outlet 26 is a vent which exhausts to atmosphere. Valve 20 acts a regulator valve and is provided with a pressure adjustor 28, the condition of which can be adjusted by a user in order to vary the amount of air supplied by the air pump 30 to the water tank 10. This is accomplished by diverting air from the inlet 22 to the vent 26 in preference to the outlet 24, in a ratio dependent on the condition of the adjustor 28. The pressure adjuster 28 includes an adjusting rod within valve 20 that acts on a resilient rubber seal of vent 26. According to the amount of pressure which is applied to the resilient rubber seal by the adjusting rod, the resilient rubber seal is opened, in order to allow air to bleed through the seal to atmosphere. The position of the adjusting rod is in turn determined by the condition of pressure adjustor 28 selected by the user.

Water tank 10, which has previously been filled by the user with water via inlet 12 is therefore pressurized with air to the same degree. Water tank 10 is provided with an outlet 18 which is connected to an inlet 82 of a pressure release valve 80, which itself has an outlet 84 in fluid communication with atmospheric air. The pressure release valve 80 is arranged to allow water and/or air above a certain predetermined pressure to escape via outlet 84 to atmospheric air. The predetermined pressure is set at a value greater than the value which normally allows water to pass via outlet 16 of water tank 10 to boiler 40. Thus, if pressure in the water tank 10 builds up to a dangerous degree, for example because of a blockage downstream of water tank 10, rather than the pressure being increased further by the pumping action of air pump 30 until the apparatus risks exploding, the pressure is instead released via outlet 84. This is provided as a safety feature of the apparatus.

Assuming there is no such blockage, water is accordingly pumped from outlet 16 of water tank 10 by the air pressure bearing down on it to the inlet 112 of water filter 110. Here, the water is filtered in order to remove low solubility salts, such as calcium carbonate, via an ion exchange resin, before the water is next passed via outlet 114 of the water filter 110 towards second valve 50 and boiler 40. Apart from the ion exchange resin, the water filter 110 may also contain a sponge to filter out any foreign bodies, thereby protecting the boiler 40 still further.

Outlet 114 of filter 110 is in fluid communication with inlet 52 of a second valve 50, an outlet 54 of which is in turn in fluid communication with an inlet 42 of boiler 40.

The second valve 50 has a predetermined pressure, above which it will allow water to flow into boiler 40, but below which it blocks the passage of water into the boiler. This predetermined pressure is set at a value lower than that set for pressure release valve 80, so that a normal range of operating pressures of boiler 40 lies between the predetermined pressure value of second valve 50 and the predetermined pressure value of pressure release valve 80. Exactly where within this range of normal operating pressures the boiler operates at is determined by the setting of regulator valve 20 which has been chosen by the user via pressure adjustor 28. This in turn determines how fast water passes through the boiler 40 and is turned into steam, and therefore how much steam, in terms of volume of steam per unit time, exits outlet 44 of boiler 40. The steam thus generated then passes via connector 46 to pivot connector 48 and to nozzle connector 142 of steam cleaning head 60.

In the illustrated embodiment of FIG. 2, the electrical power supplied to air pump 30 includes a time-delay circuit 160, so that air pump 30 only starts to pump air through the system after a five second delay, because boiler 40 takes five seconds to heat up from ambient temperature to a temperature of 110 degrees Celsius. A thermostat 162 connected to the boiler 40 then ensures that the temperature of boiler 40 is held within a range of from 110 to 145 degrees Celsius once boiler 40 has heated up. Thus water entering boiler 40 is converted into steam almost instantaneously upon its entry into the boiler via inlet 42 and the possibility that water can pass through the boiler and exit the floor cleaning head 60 without being converted into steam is thereby avoided.

Figure 4:
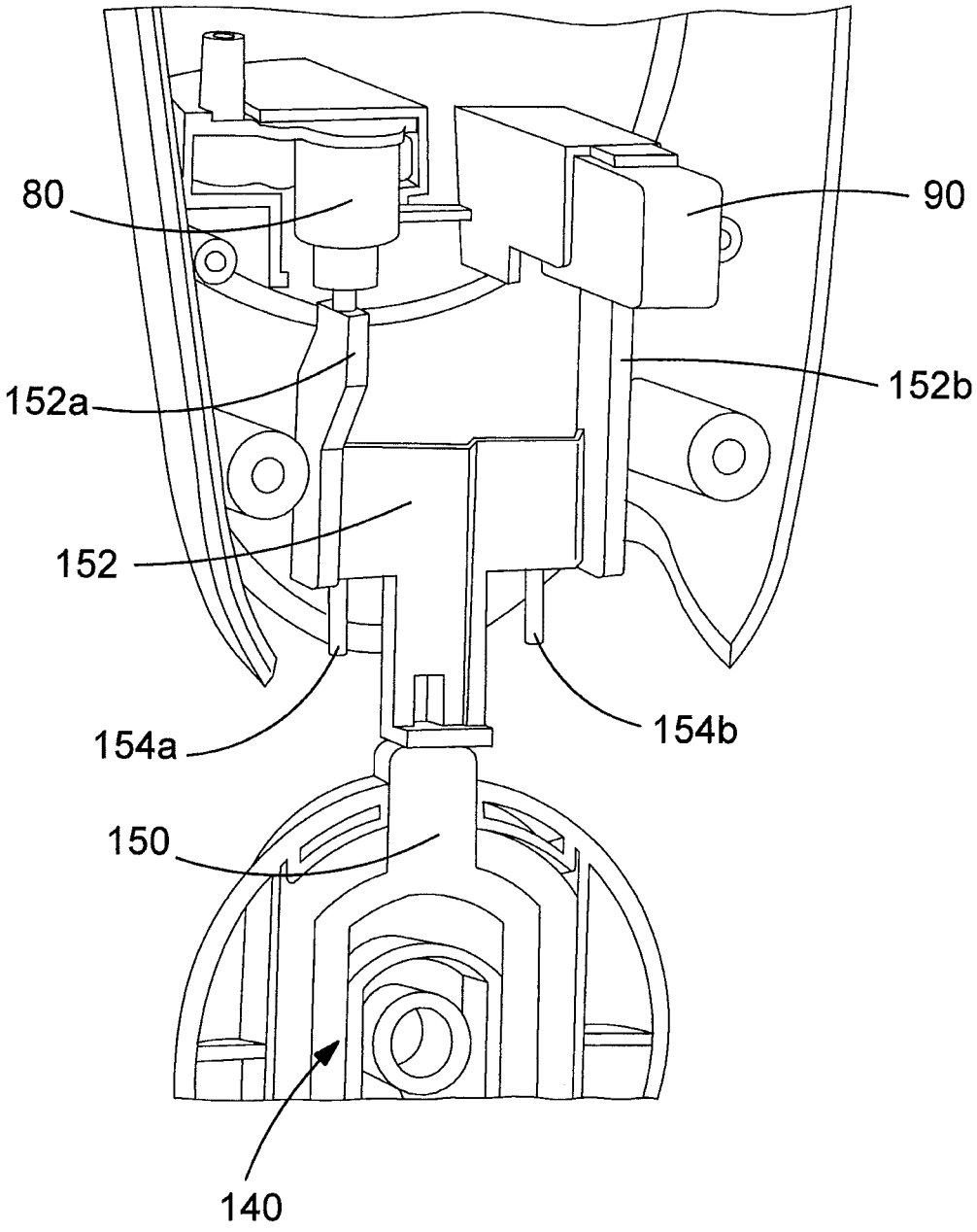
FIG. 4 is a close-up, exposed view of where the main body portion of the steam cleaning apparatus shown in FIGS. 1 and 2 connects with a steam cleaning head thereof.

FIG. 4 shows in close-up an exposed view of where the main body portion 120 of the steam cleaning apparatus 100 connects with the steam cleaning head 60. As may be seen in FIG. 4, the universal joint 140 includes a member 150 which acts upon a spring-loaded yoke 152. One arm 152*a* of yoke 152 engages with pressure release valve 80 and another arm 152*b* of yoke 152 engages with a position-sensitive microswitch 90. Microswitch 90 is connected in electrical series with main on-off switch 70 of steam cleaning apparatus 100. At the other end of yoke 152 are two prongs 154*a*, 154*b*, on each of which is mounted a respective coiled spring (not shown), each such spring also being mounted to an interior surface of the main body 120 of the steam cleaning apparatus 100. Thus, when the steam cleaning apparatus 100 is put in a substantially vertical, storage position, member 150 of universal joint 140 pushes on spring-loaded yoke 152, one arm 152*a* of which in turn presses on pressure release valve 80 and the other arm 152*b* of which in turn presses on the position-sensitive microswitch 90. This has the effect of first, opening the pressure release valve 80 thereby releasing air pressure from the water tank 10 until it returns to atmospheric pressure, and secondly of interrupting the flow of electrical current from the main on-off switch 70 to air pump 30 and boiler 40. At the same time, the two coiled springs are placed in tension.

Figure 5:
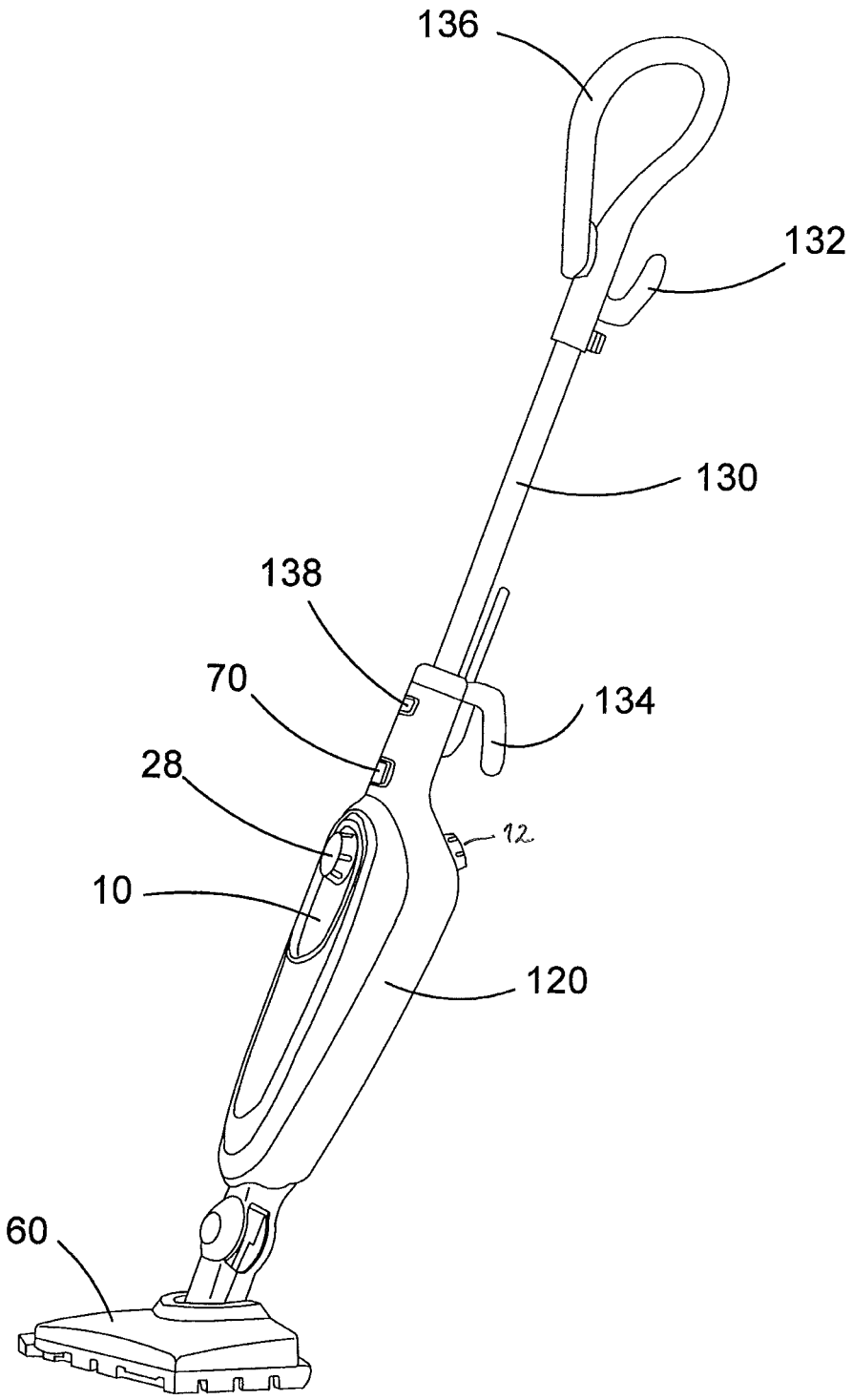
FIG. 5 shows the steam cleaning apparatus of FIGS. 1 and 2 in a tilted, cleaning position.

On the other hand, when the steam cleaning apparatus 100 is put in a tilted, cleaning position, as shown in FIG. 5, member 150 withdraws from spring-loaded yoke 152 and the two arms 152*a*, 152*b* disengage from the pressure release valve 80 and the position-sensitive microswitch 90 by the action of the two springs. Thus, pressure can now build up in the water tank 10 and electrical power can also be supplied to both the pump 30 and the boiler 40. Although in the presently described embodiment, both the main on-off switch 70 and the pressure release valve 80 are affected by whether the steam cleaning apparatus is put in a substantially vertical, storage position or in a tilted, cleaning position, alternative embodiments in which only one or neither of these features are present are also possible. However, both are preferred as safety features, as well as providing increased convenience for the user.

An additional feature of the described invention is an indicator light 164 connected in series with the main on-off switch 70 of the apparatus. For greater aesthetic appeal, this indicator light 164 is mounted within the interior of main body portion 120 of the apparatus, but water tank 10 is made of a translucent plastics material, so that light from the indicator light 164 is able to shine through the water tank 10 and thus be visible by a user from the exterior of the apparatus as an apparent illumination of water tank 10.

The indicator light 164 has a first colour for indicating when the steam cleaning apparatus 100 is powered on but is not ready to use and a second colour for indicating when the steam cleaning apparatus 100 is powered on and is ready to use. In order to achieve this, the indicator light 164 has a first condition associated with the first colour, a second condition associated with the second colour and a third condition not associated with either the first or the second colour.

These first, second and third conditions of the indicator light 164 are achieved by electrical wiring of the indicator light 164 in the appropriate fashion, as follows:

The first condition of the indicator light 164 is induced by the on-off switch 70 being put in the "on" state by a user and either the air pump 30 being prevented from receiving a supply of electrical power by the time delay circuit or the thermostat detecting that the temperature of steam generated by the boiler 30 is outside the operating temperature range. The second condition is induced by the on-off switch 70 being in the "on" state and the air pump 30 receiving a supply of electrical power unhindered by the time delay circuit and the thermostat detecting that the temperature of steam generated by the boiler 30 is within the desired operating temperature range. The third condition is induced by the on-off switch 70 being in the "off" state thereof. When on-off switch 70 is in an "off" state, the indicator light remains off and no colour is displayed due to the absence of any electrical current flowing therethrough. However, when the on-off switch 70 is put in an "on" state by the user, the indicator light illuminates the water tank 10 with colours as shown in the following Table 1:

TABLE 1

| Colour of indicator light | Temperature of steam detected by thermostat within operating temperature range | Temperature of steam detected by thermostat outside operating temperature range |
|---|---|---|
| Air pump on | Blue | Red |
| Air pump off | Red | Red |

Thus, in the described embodiment, red is the first colour of the indicator light and blue is the second colour. However, it may be understood that any other colours could be chosen instead as the first and second colours, for example yellow and green respectively. It should also be understood that in an alternative embodiment in which the boiler of the steam cleaning apparatus is not provided with a thermostat, the first condition of the indicator light is induced by the on-off switch 70 being put in the "on" state by a user and the air pump 30 being prevented from receiving a supply of electrical power by the time delay circuit, and the second condition is induced by the on-off switch 70 being in the "on" state and the air pump 30 receiving a supply of electrical power unhindered by the time delay circuit. In still yet a further embodiment in which the boiler does include a thermostat and the steam cleaning apparatus is not provided with a time delay circuit, the first condition of the indicator light is instead induced by the on-off switch 70 being put in the "on" state by a user and the thermostat 162 detecting that the temperature of steam generated by the boiler 40 is outside the operating temperature range, whereas the second condition is induced by the on-off switch 70 being in the "on" state and the thermostat 162 detecting that the temperature of steam generated by the boiler 40 is within the desired operating temperature range. In all cases, however, the third condition of the indicator light 164 is always induced by the on-off switch 70 being put in the "off" state by the user.

The invention claimed is:

1. A steam cleaning apparatus comprising:

a main body having a main switch;

a steam cleaning head coupled to the main body; and a position sensitive switch having a first state when the steam apparatus is in a substantially vertical storage position and a second state when the steam cleaning apparatus is in a tilted, cleaning position, the position sensitive switch being connected in electrical series with the main switch such that when the position-sensitive switch is in the first state the position-sensitive switch interrupts the flow of electrical current from the main switch and when the position-sensitive switch is in the second state, electrical power is supplied by the main switch.

2. The steam cleaning apparatus according to claim 1 wherein the steam cleaning apparatus comprises a universal joint joining the steam cleaning head and the main body.

3. The steam cleaning apparatus according to claim 2 wherein the universal joint includes a protruding member that contacts a yoke, the yoke engaging the position sensitive switch.

4. The steam cleaning apparatus according to claim 3, wherein the yoke includes two arms, a first arm engaging the position sensitive switch, and a second arm engaging a pressure release valve.

5. The steam cleaning apparatus according to claim 1 wherein the position sensitive switch comprises a microswitch.

* * * * *